United States Patent [19]

Musgrave

[11] 4,387,525

[45] Jun. 14, 1983

[54] MAGAZINE ENGAGEMENT DEVICE

[76] Inventor: Daniel D. Musgrave, 8201 Caraway St., Cabin John, Md. 20818

[21] Appl. No.: 283,505

[22] Filed: Jul. 15, 1981

[51] Int. Cl.[3] ..... F41C 25/02

[52] U.S. Cl. ..... 42/50; 42/90

[58] Field of Search ..... 42/50, 6, 7, 18, 22, 42/90, 1 MH; 224/182, 183, 239

[56] References Cited

U.S. PATENT DOCUMENTS

| | | | |
|---|---|---|---|
| 4,107,863 | 8/1978 | Musgrave | 42/50 |
| 4,115,943 | 9/1978 | Musgrave | 42/90 |
| 4,120,109 | 10/1978 | Musgrave | 42/90 |

*Primary Examiner*—Charles T. Jordan

[57] ABSTRACT

A device for engaging a cartridge magazine with a support in a convenient attitude for rapid insertion into a firearm. In order that the insertion may be accomplished by moving either the firearm, or the magazine, or both, the device is so positioned that it can not interfere with the process of insertion.

12 Claims, 6 Drawing Figures

MAGAZINE ENGAGEMENT DEVICE

Many modern firearms use detachable magazines which are removed from the firearm and replaced when empty. The exchange of magazines sometimes takes place at a critical moment, perhaps in military combat, where any considerable delay is unacceptable. One source of delay is the necessity for orienting each magazine correctly before inserting it into its receptacle on the firearm. It also requires a significant amount of time to remove such magazines from the pouches in which they are normally carried.

The principal object of this invention is to provide an engagement device on a cartridge magazine whereby said magazine can be engaged with a support in an attitude convenient for a user who is about to insert it into a firearm.

This and other objects of the present invention will be apparent upon reference to the following specification, taken in connection with the accompanying drawings, wherein.

Figure 1:
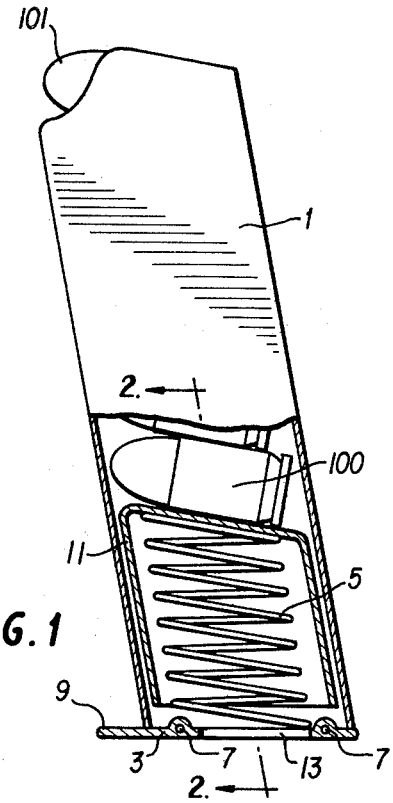
FIG. 1 is a side elevation, partly sectioned, of a cartridge magazine incorporating the present invention.

The magazine shown in the drawings is merely exemplary. It is not intended to limit the scope of utility of the invention to any magazine or class of magazines.

Referring to the drawings in detail, FIG. 1 shows a cartridge magazine comprising a casing 1, a floor 3, and a spring 5. The floor is secured to the casing by pins 7 in a well-known manner. The floor also has a projection 9 which may be used for withdrawing the magazine from a firearm if it should tend to stick therein. Slideably disposed in casing 1 is a typical cartridge follower 11, on top of which rests a cartridge 100. At the top of the magazine another cartridge 101 is in position for ramming. The details described thus far are well-known in the art.

Figure 2:
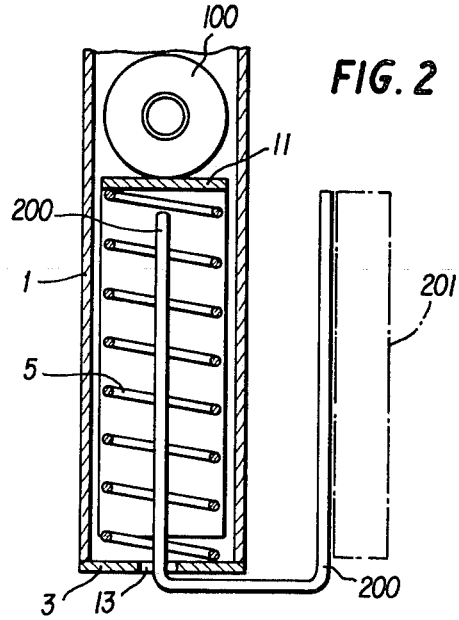
FIG. 2 is a section taken in the plane indicated by arrows 2—2 on FIG. 1.

Formed through floor 3 is a slot or passage 13, which is visible both in FIG. 1 and FIG. 2. The purpose of the slot is to provide an entry for a support means 200 which is so configured as to be capable of entering the magazine from below, via the slot. Outside the magazine, the support means may be affixed to any convenient structure. Such a structure is indicated by box 201, drawn in broken lines.

It should be emphasized that the present invention is not restricted to use with any particular type of structure. Examples of such a structure might be the clothing or equipment of a user; a firearm; a boat; a land vehicle; an aircraft; or a fixed structure. The foregoing list is not intended as a limitation.

In use, a magazine supported in the manner disclosed in FIG. 2 would be removed upwardly from support means 200. This could be accomplished by merely lifting the magazine in the users hands, and then inserting it into a firearm. Removal of the magazine from the support would be accomplished in one quick and simple motion.

It would also be possible to remove the magazine from the support by means of the firearm with which it is used. In FIG. 2, it can be seen that there is clear space all around the magazine. If the firearm is moved so that its receptacle encompasses the magazine, well-known cooperating latch means will hold the magazine in the receptacle so that lifting the firearm will remove the magazine from the support means.

When the magazine has been inserted into the firearm by either method the user can continue to fire after only a minimum delay to exchange magazines.

Figure 3:
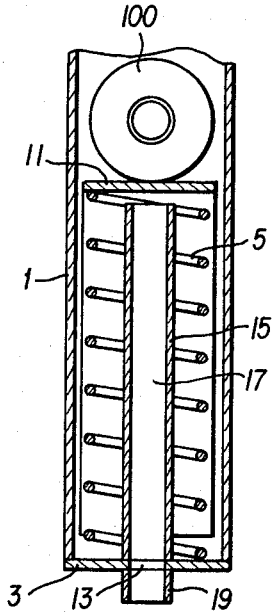
FIG. 3 is a section similar to FIG. 2 but showing an alternate arrangement.

FIG. 3 shows an alternate construction. Inside casing 1 in the void encompassed by spring 5 is positioned a hollow member 15. Member 15 is secured to floor 3 in any convenient manner. It includes an interior recess 17 which is shaped and dimensioned to permit the insertion of support means 200 therein. If the length of member 15 is not sufficient, it may be desirable to provide an extension 19, protruding below and fixed to floor 3. Of course the slot 13 in floor 3 must be alined with the recesses in member 15 and extension 19.

Operation of the device shown in FIG. 3 is similar to that described for FIG. 1 and FIG. 2. However, the provision of a member with a recess closely encompassing the support means will support the magazine more firmly.

Figure 4:
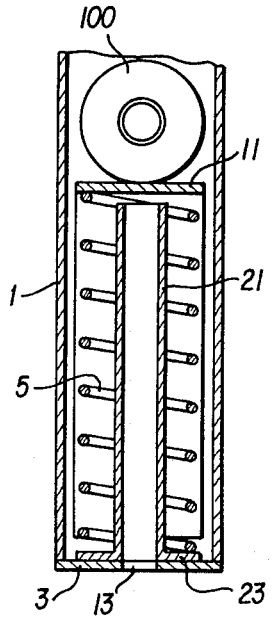
FIG. 4 is another section similar to FIG. 2 and showing another alternate arrangement.

FIG. 4 shows another arrangement. Member 21 has a flange 23 at its lower end. The member is positioned so that the flange is between spring 5 and floor 3. It is not necessary to attach the member to the floor. Operation is similar to that described for FIG. 3.

Figure 5:
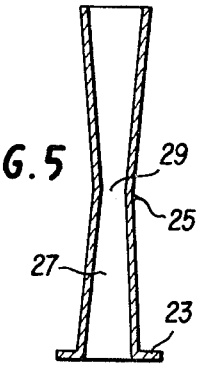
FIG. 5 shows an alternate detail for a part of FIG. 4.

It is necessary to provide some restraint to prevent accidental removal of the magazine from the support means. FIG. 5 shows how this may be done by providing a resilient member 25 having a recess 27 adapted to tightly grip the support means when inserted. The recess might be constricted as at 29, or any suitable equivalent means can be employed to prevent inadvertent withdrawal of the support means from the recess.

Member 25 can be installed and used in substantially the same way as member 21, previously described.

If a member, such as 25, is made of a magnetic material, the support means might be made as a magnet, thus providing additional restraint against removal of the magazine from the support means. Conversely, the member might be a magnet and the support means made of magnetic material.

Although the drawings illustrate a magazine using a wire coil spring, the invention can also be used with a magazine employing a folded leaf spring. This could be done by merely providing slots through the leaves to accommodate the support means.

An obvious modification of the disclosed device would be the provision of a mechanical latch to retain the magazine on the support means. This, however, would increase the time required to make the exchange of magazines. Another possibility would be to make the hollow member and the floor of the magazine as a single piece. A member such as that shown in FIG. 4 could also serve to limit movement of the follower so as to prevent insertion of too many cartridges into the magazine.

Figure 6:
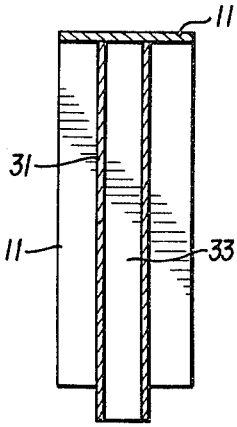
FIG. 6 is a section of a cartridge follower showing another alternate arrangement.

The member can also be affixed to the cartridge follower of the magazine. In FIG. 6 member 31 extends downward from follower 11. When the magazine is filled with cartridges it would touch the floor. The spring would be wrapped around member 31 and recess 33 in the member would be alined with suitable passage means in the floor of the magazine. Details or operation would be similar to those described earlier for FIGS. 3 and 4.

There is thus disclosed a simple magazine engagement device which can be applied to various types of magazines, both existing and future. It is particularly desired to call attention to the fact that the present invention does not require any significant increase in the weight or the bulk of a typical magazine.

I claim:

1. In a cartridge magazine including a casing having a compression spring positioned therein, passage means positionally adapted for insertion of support means into a void encompassed by said spring whereby said magazine can be supported in an extended manner.

2. In a cartridge magazine including a casing and a floor: a hollow member affixed to said floor and extending inside said casing; and passage means in said floor communicating with a recess in said member whereby external support means can be inserted into said recess via said passage means thus supporting said magazine in an extended manner.

3. A magazine as set forth in claim 2 wherein said member also extends outside of said casing.

4. A magazine as set forth in claim 2 wherein said member is resilient.

5. A magazine as set forth in claim 2 wherein said member is adapted to exert substantial frictional resistance to removal of said support means from said recess.

6. A magazine as set forth in claim 2 wherein said member is integral with said floor.

7. A magazine as set forth in claim 2 wherein longitudinal axes of said casing, said member, and said recess are substantially parallel.

8. A magazine as set forth in claim 2 wherein there is mutual magnetic attraction between said member and said support means.

9. In a cartridge magazine including a casing and a floor: a compression spring positioned in said casing; a hollow member encompassed by said spring and juxtaposed said floor; and passage means in said floor communicating with a recess in said member whereby external support means can be inserted into said recess thus supporting said magazine in an extended manner.

10. A magazine as set forth in claim 9 wherein said member includes a flange interposed between said spring and said floor.

11. A magazine as set forth in claim 2 or claim 3 wherein said member is positionally adapted for limiting movement of a follower slideable in said casing.

12. In a cartridge magazine including a casing having a follower slideable therein: a hollow member affixed to said follower and extending toward a floor affixed to said casing; and passage means in said floor aligned with a recess in said member whereby external support means can be inserted into said recess via said passage means thus supporting said magazine in an extended manner.

* * * * *